United States Patent [19]

Johnson et al.

[11] 4,132,454

[45] Jan. 2, 1979

[54] THREE POSITION SEWING MACHINE CABINET PLATFORM

[75] Inventors: Ralph E. Johnson, Convent Station; John A. Urciola, South Bound Brook, both of N.J.

[73] Assignee: The Singer Company, New York, N.Y.

[21] Appl. No.: 863,549

[22] Filed: Dec. 22, 1977

[51] Int. Cl.[2] ..... A47B 81/00

[52] U.S. Cl. ..... 312/27; 112/217.1; 312/30

[58] Field of Search ..... 312/21-24, 312/27-30; 112/217.1, 258, 260

[56] References Cited

U.S. PATENT DOCUMENTS

| | | | |
|---|---|---|---|
| Re. 28,835 | 1/1976 | Roberts | 312/29 |
| 3,870,386 | 3/1975 | Shepard | 312/30 |
| 4,005,918 | 2/1977 | Smith et al. | 312/27 |

*Primary Examiner*—Casmir A. Nunberg
*Attorney, Agent, or Firm*—Robert E. Smith; Edward W. Goodman; Edward L. Bell

[57] ABSTRACT

A platform for mounting a sewing machine in a cabinet is disclosed which is pivotally mounted to the cabinet thereby allowing the sewing machine to be stored within the cabinet without being removed from the platform. This platform is intended for cylinder bed or convertible bed sewing machines in that it is also capable of raising and lowering the sewing machine, between a position where the work supporting surface of the sewing machine is coplanar with the cabinet top and a position where the work supporting surface is spaced above the cabinet top, without an accompanying horizontal shifting component. This enables the cabinet to be formed with a smaller sewing machine opening minimizing any gaps between the cabinet and the sewing machine and eliminating additional inserts needed to close these gaps.

6 Claims, 6 Drawing Figures

THREE POSITION SEWING MACHINE CABINET PLATFORM

BACKGROUND OF THE INVENTION

This invention relates to sewing machine cabinets, and in particular, to devices installed in sewing machine cabinets for supporting the sewing machine in various positions.

The prior art discloses cabinets having means for selectively supporting a sewing machine in an operative position and a storage position. These cabinets were intended primarily for flat bed sewing machines and, as such, the sewing machine would be supported with the work supporting surface thereof coplanar with the top of the cabinet. In U.S. Pat. No. 3,788,716 of Roberts et.al. (reissued as U.S. Pat. No. Re. 28,835), there is described a cabinet which, in addition to supporting a sewing machine in an operative position and a storage position, is capable of raising the sewing machine above the top of the cabinet completely exposing the bed thereof. This is particularly useful with free arm sewing machines or sewing machines having convertible beds. However, in raising the sewing machine, there is also a horizontal shifting motion requiring an enlargement of the sewing machine access opening which, in turn, requires the use of an insert to close the resulting gap between the sewing machine and the cabinet.

SUMMARY OF THE INVENTION

The object of this invention is to provide a sewing machine mounting platform having a storage position and two operative positions, a lowered flat-bed position and a raised free-arm position, wherein the moving of the sewing machine from the flat-bed to the free-arm position entails no horizontal shifting of the sewing machine. This object is achieved through the use of a sewing machine mounting cradle arranged above a base in parallel relation thereto. The cradle and the base are interconnected by parallel acting hinges pivotally attached at one end to the base and pivotally and shiftably attached at the other end to the cradle. When the cradle is raised or lowered, the hinges pivot and shift on the cradle allowing it to be moved vertically without any horizontal shifting.

A further object of this invention is to provide a sewing machine mounting and lifting platform which component parts are locked together in the flat-bed position when the platform is in its storage position, and which is locked in its operative position when the sewing machine is raised in the free-arm position.

DESCRIPTION OF THE DRAWINGS

With the above and additional objects and advantages in view as will hereinafter appear, this invention will be described with reference to the drawings of the preferred embodiment in which.

DESCRIPTION OF THE PREFERRED EMBOIDMENT

Figure 1:
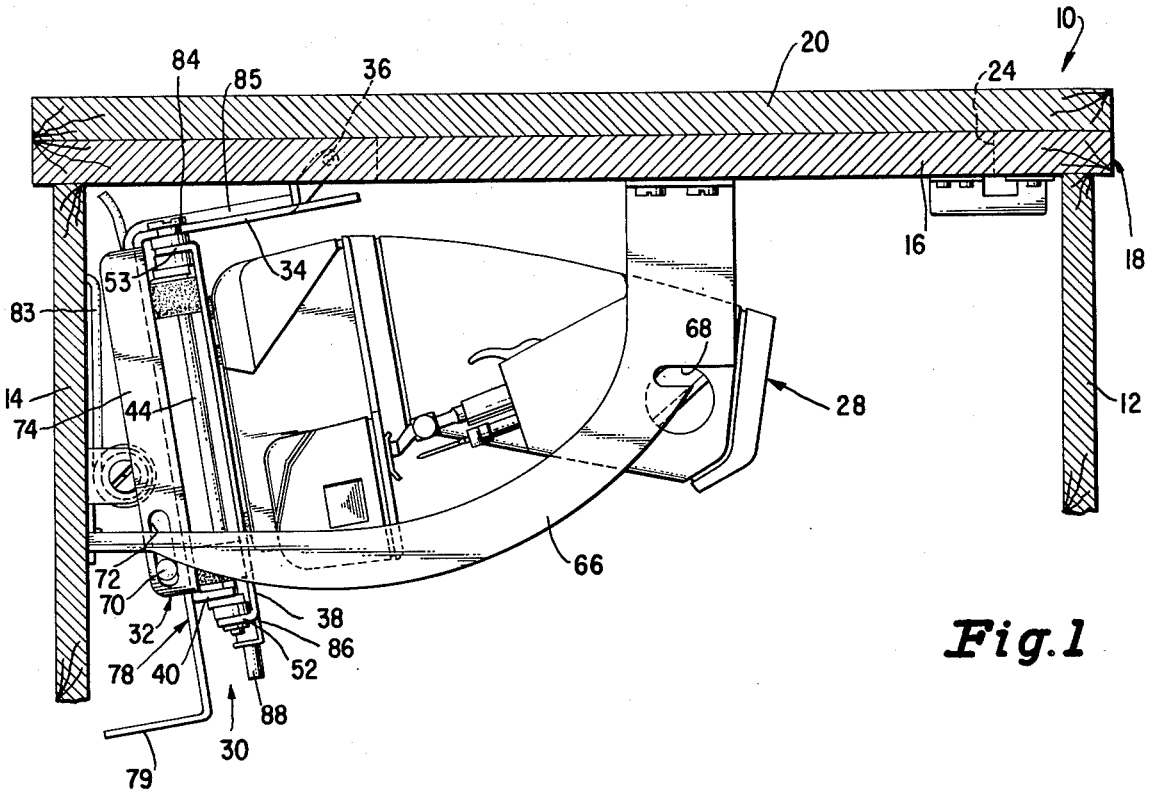
FIG. 1 is a side elevational view of a sewing machine cabinet, partly in section, showing the invention incorporated therein carrying a sewing machine in the stored position.
Figure 2:
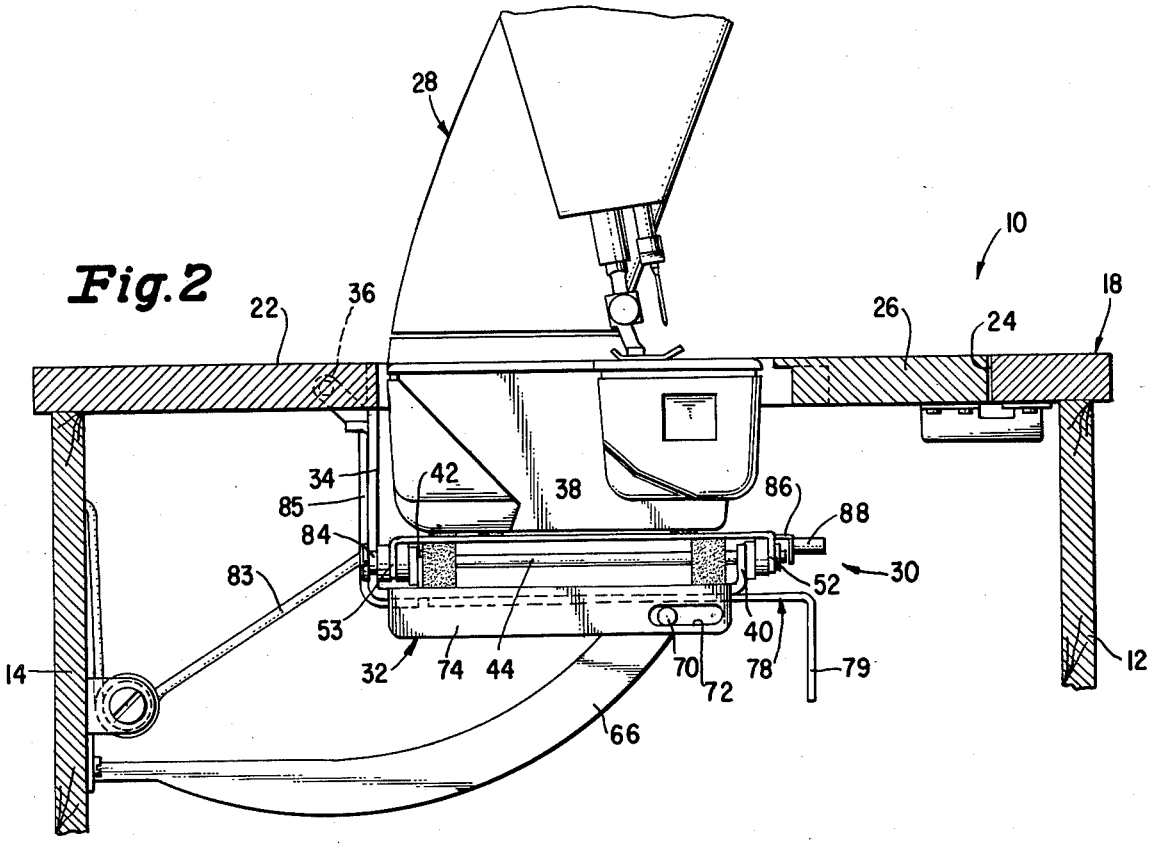
FIG. 2 is a side elevational view of a sewing machine cabinet, as in FIG. 1, with the invention supporting the sewing machine in the flat-bed mode.
Figure 3:
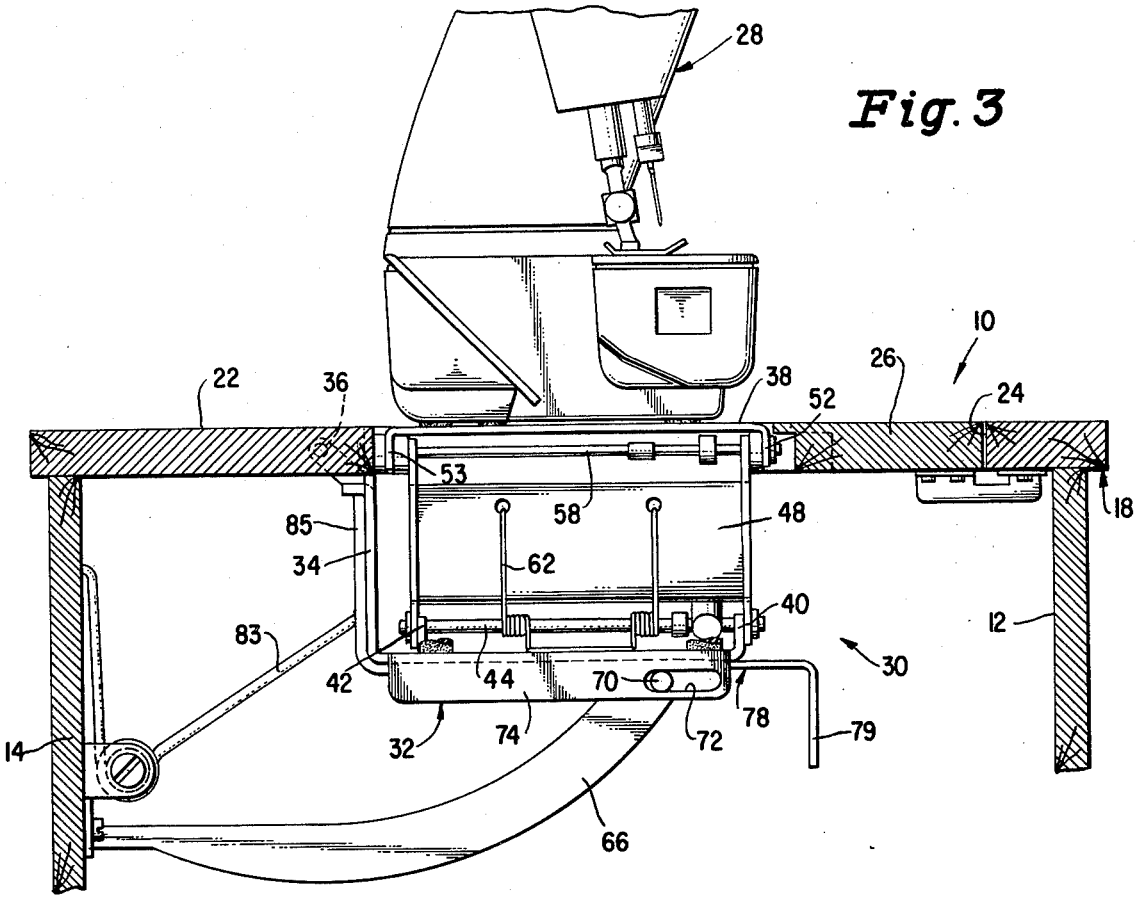
FIG. 3 is a side elevational view of a sewing machine cabinet, as in FIG. 1, with the invention supporting the sewing machine in the free-arm mode.
Figure 4:
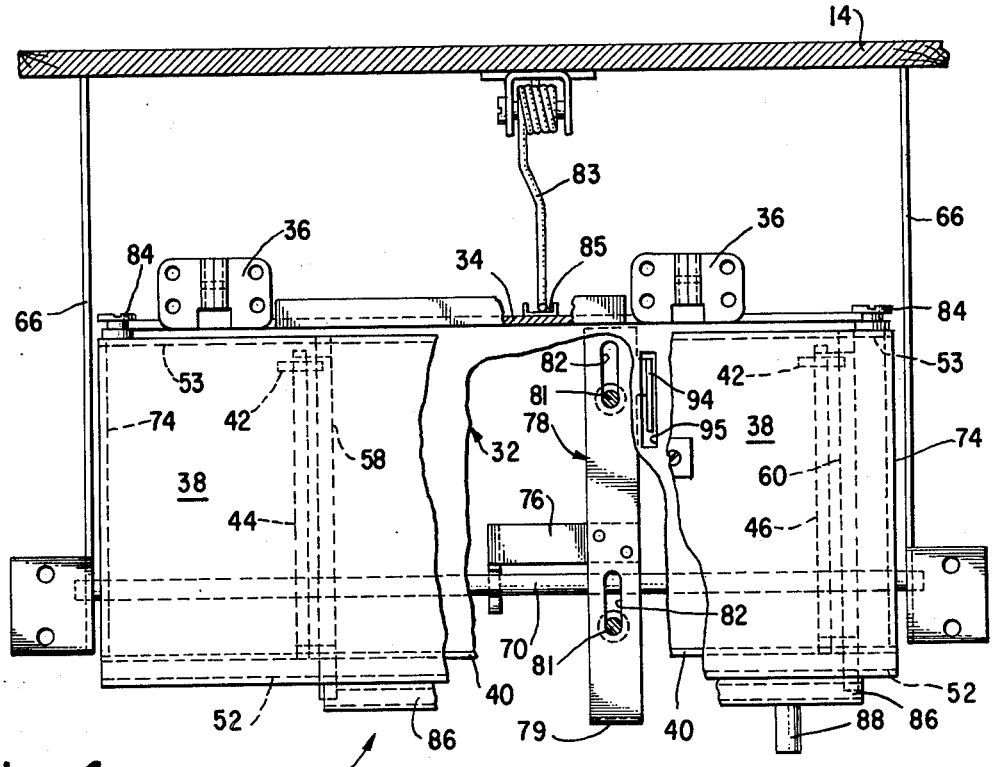
FIG. 4 is a top plan view, partly in section, of the invention showing the storage actuating lever and the mechanism therefor.
Figure 5:
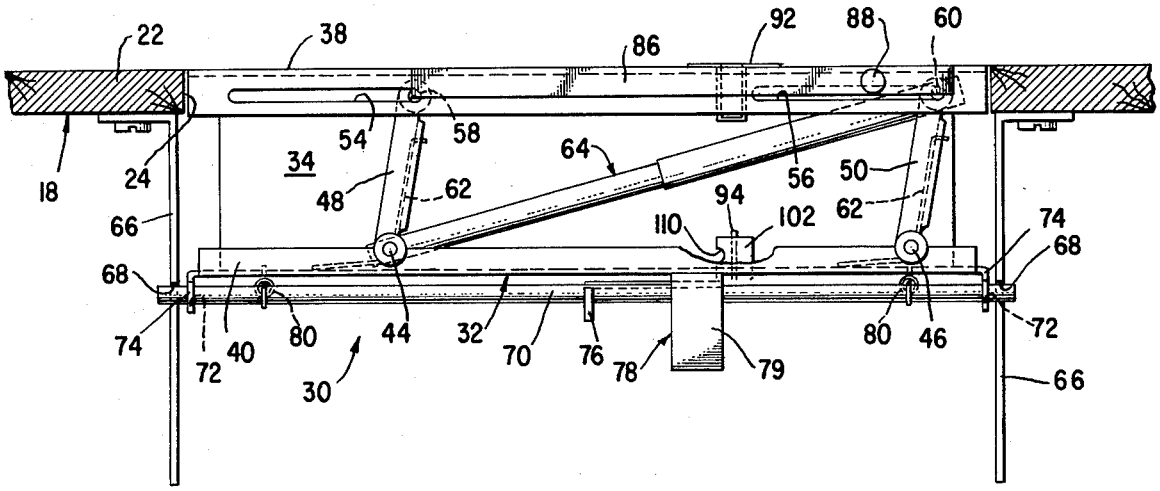
FIG. 5 is a front elevational view of the invention in the free-arm mode showing the parallel-acting hinges thereof.
Figure 6:
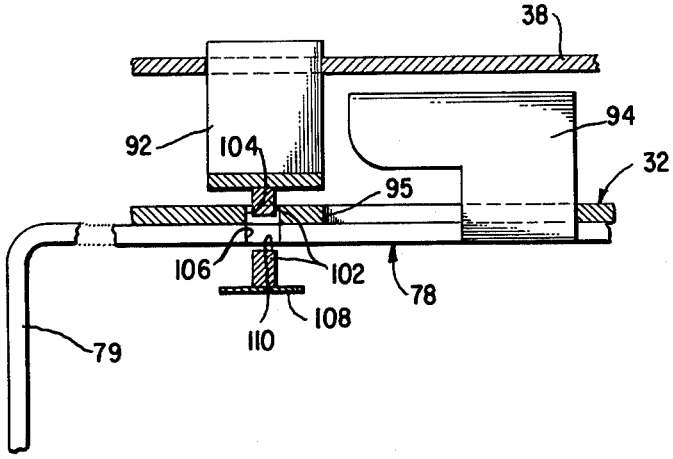
FIG. 6 is a cross-sectional view of a portion of the invention in its flat-bed mode showing the interlocks incorporated therein.

Referring to FIG. 1, a portion of a sewing machine cabinet is referenced generally by the number 10. The cabinet 10 includes a front panel 12 and a rear panel 14 both of which are fixedly attached to the bottom surface 16 of a cabinet top 18 at opposite sides thereof. The particular cabinet shown has a leaf 20 pivotally mounted to the working surface 22 of the cabinet top 18 for selectively overlying the cabinet top 18 or augmenting the working surface 22 of the cabinet top 18. The cabinet top 18 is formed with an opening 24, partially closed by a flap 26 pivotally attached to the cabinet top 18, for receiving a sewing machine 28.

The platform indicated generally at 30 of this invention is provided for supporting the sewing machine 28 in the cabinet 10 and includes a base 32 having an upwardly extending rear portion 34 pivotally mounted to the bottom surface 16 of the cabinet top 18 by hinges 36 located near the rearward edge of opening 24. A mounting cradle 38, to which the sewing machine 28 is mounted, overlies the base 32 in parallel relation thereto. The base 32 is formed with an upwardly turned flange 40 along the forward edge thereof and two upwardly turned tabs 42 spaced laterally in the base 32, equidistant from the rear portion 34. Pivot rods 44 and 46 are mounted between each of the tabs 42 and the flange 40 and have pivotally mounted thereto two hinge elements 48 and 50, respectively.

The mounting cradle 38 is formed with two downwardly turned flanges 52 and 53 along the front and rear edges thereof, both of which are formed with two laterally elongated slots 54 and 56. Two pivot rods 58 and 60 are slidably mounted within the slots 54 and 56, respectively, for spanning the two flanges 52 and 53. The free ends of hinge elements 48 and 50 are pivotally attached to the pivot rods 58 and 60, respectively. The slots 54 and 56 are positioned over the pivot rods 44 and 46, respectively, such that the hinge elements 48 and 50 may move in parallel relation to an elevated first position past the vertical, thereby rendering a stable, elevated position for the cradle 38. The slots 54 and 56 extend on the opposite side of pivot rods 44 and 46, respectively, to such an extent as will enable the pivot rods 58 and 60 to shift the hinge elements 48 and 50 to a collapsed second position allowing the cradle 38 to be lowered to a position adjacent to the base 32. Springs 62 are mounted on pivot rods 44 and 46 and engage the base 32 and each of the hinge elements, 48 and 50, biasing the hinge elements, 48 and 50, toward the elevated position. A compression spring assembly 64 is pivotally mounted between pivot rods 44 and 60 biasing the cradle 38 to its elevated position spaced above the base 32.

For selectively supporting the platform 30 in an operative position, two guide brackets 66, mounted to the bottom surface 16 of the cabinet top 18 and the rear panel 14 on opposite ends of the platform 30, are each formed with a notch 68 as shown in FIG. 1. The notches 68 are selectively engaged, at the same time, by a transaxially shiftable bar 70 which is mounted within two slots 72, each slot being formed in one of the downwardly turned flanges 74 appending from opposite ends of the base 32. The bar 70 may be shifted out of the notches 68 by a bracket 76 attached to the mid-point of the bar 70 and mounted on an actuating lever 78. Two springs 80 are attached to the base 32 and to the bar 70 for biasing the bar 70 into the notches 68. The actuating lever 78 is slidably mounted to the base 32 by two shoulder screws 81 arranged to pass through two slots 82 formed in the actuating lever 78. The end of the actuating lever 78 is downwardly turned forming a handle 79 which is accessible to an operator by reaching under the cabinet 10, grasping and pulling the handle 79. A spring 83 is provided for biasing the platform 30 in its operative position. The spring 83 is mounted to the rear panel 14 and engages a guide track 85 mounted on the upward extending portion 34 of the base 32.

The edges of the rear portion 34 are vertically formed and are engaged by two rollers 84 attached to opposite ends of the flange 53. This assembly acts as a guide for the mounting cradle 38 limiting the movement thereof to vertical travel only.

For lowering the cradle 38 from its stable, elevated position to the lowered position adjacent to the base 32, a laterally movable slide bar 86 is pivotally attached to both pivot rods 58 and 60 in front of the flange 52. The slide bar 86, which carries handle 88, accessible to the operator by pivotally swinging the flap 26 upwardly, may be shifted laterally in opposition to the compression spring assembly 64 allowing the cradle 38 to be lowered, also in opposition to the compression spring assembly 62.

The platform 30 is provided with two automatic interlocks for locking the mounting cradle 38 to the base 32 when the platform 30 is out of the operative position and for preventing operation of the actuating lever 78 when the mounting cradle 38 is elevated from the base 32. The first interlock includes a "U"-shaped bracket 92 mounted to the underside of the cradle 38 and a finger 94, extending through a slot 95 in the base 32, mounted to the actuating lever 78. When the cradle 38 is in its lowered position, by shifting the actuating lever 78 to move the bar 70 out of engagement with the notches 68, the finger 94 is brought into engagement with the "U"-shaped bracket 92 thereby locking the cradle 38 to the base 32. The second interlock includes a bar 102 arranged to move within a slot 104 formed in the base 32, and the actuating lever 78 being formed with a notch 106 for embracing the bar 102 preventing the actuating lever 78 from shifting. A leaf spring 108 attached to the base 32 urges the bar 102 upwardly. The bar 102 is positioned to underlie the "U"-shaped bracket 92 on the cradle 38 and is urged downwardly thereby when the cradle 38 is in its lowermost position. At this point, a cutout 110 formed in the bar 102 will overlie notch 106 formed in the actuating lever 78 thereby allowing the lever 78 to shift.

Numerous alterations of the structure herein disclosed will suggest themselves to those skilled in the are. However, it is to be understood that the present invention which is for purposes of illustration only and not to be construed as a limitation of the invention. All such modifications which do not depart from the spirit of the invention are intended to be included within the scope of the appended claims.

Having thus set forth the nature of this invention, what is herein claimed is:

1. A platform for mounting a sewing machine in a cabinet comprising:

a base pivotally mounted within said cabinet;

a sewing machine mounting cradle arranged in parallel relation to said base;

a plurality of hinges interconnecting said cradle in said base for selectively raising and lowering said cradle between a first position adjacent said base and a second position vertically spaced above said base, each of said hinges having a first end pivotally attached to said base and a second end pivotally and shiftably attached to said cradle enabling perpendicular translation of said cradle with respect to said base;

means for selectively securing said platform in an operative position; and guide means attached to said cradle and said base for preventing any horizontal shifting of said cradle.

2. A mounting platform as set forth in claim 1 wherein said hinges operate in parallel relation.

3. A mounting platform as set forth in claim 1 which further comprises means for biasing said cradle in said second position.

4. A mounting platform as set forth in claim 1 which further comprises interlocking means for locking said platform in said operative position while said cradle is out of said first position.

5. A mounting platform as set forth in claim 1 which further comprises means for lockably retaining said cradle in said first position while said platform is out of said operative position.

6. A platform for mounting a sewing machine in a cabinet comprising:

a base pivotally mounted within said cabinet;

a sewing machine mounting cradle arranged in parallel relation to said base;

a plurality of parallel operating hinges for selectively raising and lowering said cradle between a first position adjacent said base and a second position vertically spaced above said base, each of said hinges having a first end pivotally attached to said base and a second end pivotally and shiftable attached to said cradle;

means for selectively securing said platform in an operative position;

guide means attached to said cradle and said base preventing any horizontal shifting of said cradle;

means for biasing said cradle into said second position;

means for locking said platform in said operative position while said cradle is out of said first position; and means for lockably retaining said cradle in said first position while said platform is out of said operative position.

* * * * *